US007604715B2

(12) United States Patent
Liesén et al.

(10) Patent No.: US 7,604,715 B2
(45) Date of Patent: Oct. 20, 2009

(54) PAPERMAKING PROCESS

(75) Inventors: Jonas Liesén, Jörlanda (SE); Kerstin Malmborg-Nyström, Ödsmål (SE)

(73) Assignee: Akzo Nobel N.V., Arnhem (NL)

( * ) Notice: Subject to any disclaimer, the term of this patent is extended or adjusted under 35 U.S.C. 154(b) by 222 days.

(21) Appl. No.: 11/589,494

(22) Filed: Oct. 30, 2006

(65) Prior Publication Data

US 2007/0107866 A1 May 17, 2007

Related U.S. Application Data

(60) Provisional application No. 60/737,720, filed on Nov. 17, 2005.

(51) Int. Cl.
*D21H 11/00* (2006.01)

(52) U.S. Cl. ..... 162/181.8; 162/158; 162/181.7; 162/179; 162/172

(58) Field of Classification Search ..... 162/181.8, 162/158, 181.7, 179, 172
See application file for complete search history.

(56) References Cited

U.S. PATENT DOCUMENTS

| | | | | |
|---|---|---|---|---|
| 2,630,410 | A | 3/1953 | Clapsadle et al. | 252/313 |
| 4,753,710 | A | 6/1988 | Langley et al. | 162/164.3 |
| 5,368,833 | A | 11/1994 | Johansson et al. | 423/338 |
| 5,698,076 | A | 12/1997 | Phan et al. | 162/111 |
| 5,779,785 | A | 7/1998 | Payton et al. | 106/487 |
| 6,284,099 | B1 | 9/2001 | Peutherer et al. | 162/158 |
| 2002/0096289 | A1 | 7/2002 | Frolich et al. | 162/168.1 |
| 2004/0250972 | A1 | 12/2004 | Carr | 162/164.1 |
| 2006/0099128 | A1 | 5/2006 | Andrews et al. | 423/331 |

FOREIGN PATENT DOCUMENTS

| | | | |
|---|---|---|---|
| EP | 0 235 893 | B1 | 9/1987 |
| EP | 0 235 893 | B2 | 9/1987 |
| EP | 0 491 879 | B1 | 7/1992 |
| EP | 0 782 970 | B1 | 7/1997 |
| EP | 0 882 156 | B1 | 12/1998 |
| EP | 1 586 705 | A1 | 10/2005 |
| WO | WO 91/07350 | A1 | 5/1991 |
| WO | WO 97/31152 | A1 | 8/1997 |
| WO | WO 98/07927 | A1 | 2/1998 |
| WO | WO 00/75426 | A1 | 12/2000 |
| WO | WO 02/12626 | A1 | 2/2002 |
| WO | WO 04/000729 | A1 | 12/2003 |

OTHER PUBLICATIONS

European Search Report for Application No. EP 05 11 0868 dated Jan. 30, 2006.
Iler, Ralph K., "The Chemistry of Silica", John Wiley & Sons (1979) pp. 407-409.
"Pulp; Preparation of Laboratory Sheets for Physical Testing," Scandinavian Pulp, Paper and Board Testing Committee, SCAN-C 26:76/SCAN-M 5:76 (Dec. 1975) pp. 1-4.
"Fluff; Knot content," Scandinavian Pulp, Paper and Board Testing Committee, SCAN-CM 37:85 (Aug. 1985) pp. 1-3.

*Primary Examiner*—Mark Halpern
(74) *Attorney, Agent, or Firm*—Robert C. Morriss

(57) ABSTRACT

The invention relates to a papermaking process in which the static potential of the fibers/paper product can be controlled and reduced while enhancing the softness of the produced paper product.

The papermaking process comprises adding to a suspension of cellulosic fibers:

(i) a smectite clay
(ii) at least one anionic compound selected from anionic microparticles and anionic surfactants
(iii) at least one polymer which is cationic, non-ionic or amphoteric
(iv) at least one non-ionic surfactant; and/or an oil, wax or fat.

21 Claims, No Drawings

PAPERMAKING PROCESS

The invention relates to a papermaking process in which the static potential of the fibres/paper product can be controlled and reduced while enhancing the softness of the produced paper product.

BACKGROUND OF THE INVENTION

When manufacturing paper, especially tissue and fluff, static electricity, measured as static potential, can be a problem. It can cause discharges or sparks, which disturb the production. Furthermore, if the dry fibres have a high static potential the fibres tend to glue themselves to process equipment such as mills, defiberizers and pipes. The fibres are accumulated and discharged as big lumps which create problems when forming the final fluff product. Since the formation of the final fluff product usually is made from dry fibres, an even distribution of the fibres is important and lumps of fibres should be avoided. In tissue production a product with too high or too low static potential can result in extensive dusting which in turn can result in dust explosions. Attempts to reduce the static potential usually lead to deterioration of the effect of the debonder, which is added to enhance the softness of the paper.

Conventional fluff and tissue as well as methods for making such paper are well known in the art. For products made from tissue or fluff, softness is an important feature. The debonder interferes with the natural fibre-to-fibre bonds that occur during sheet formation in the papermaking process. This reduction in bonding provides a softer, or less harsh, sheet of paper.

Most debonders contain quaternary ammonium surfactants. Since producers and consumers experience a growing environmental concern, quaternary ammonium surfactants are not always accepted. The quaternary ammonium surfactants are generally toxic to aquatic organisms and generally considered undesired chemicals.

WO 98/07927 describes the production of soft absorbent paper products using a softener. The softener comprises a quaternary ammonium surfactant, a non-ionic surfactant as well as strength additives. The softening agent is added to the cellulosic suspension before the paper web is formed.

It is an object of the present invention to provide a papermaking process that can reduce the static potential.

It is a further object of the present invention to provide a papermaking process that can control the static potential while maintaining the effect of the debonder.

It is still a further object of the present invention to provide a papermaking process, which gives the possibility to control the static potential so it can be adjusted to a certain value.

DETAILED DESCRIPTION OF THE INVENTION

The invention relates to a papermaking process comprising adding to a suspension of cellulosic fibres:

(i) a smectite clay (ii) at least one anionic compound selected from anionic microparticles and anionic surfactants (iii) at least one polymer which is cationic, non-ionic or amphoteric (iv) a non-ionic surfactant and/or an oil, wax or fat.

Smectite clays are common additives in papermaking processes, for example as fillers, in paper coatings and as a component in systems for improving retention and dewatering. Clays of smectite type which preferably are used according to the present invention are layered silicate minerals comprising both naturally occurring materials and synthetic materials. The clays should preferably be dispersible in water.

Examples of smectite clays which can be used according to the present invention include montmorillonite/bentonite, hectorite, beidelite, nontronite and saponite, preferably bentonite or hectorite. The smectite clay can be modified e.g. by introducing a cation or a cationic group, such as a quaternary ammonium group or an alkali metal, preferably an alkali metal, most preferably lithium. According to one embodiment, the smectite clay is a synthetic hectorite clay modified with lithium. This clay is sold under the name Laponite®. Examples of such clays, and the manufacturing of such clays, include those disclosed in WO 2004/000729. The smectite clay used according to the present invention preferably has a specific surface area from about 40 to about 900, more preferably from about 150 to about 600, and most preferably from about 250 to about 400 $m^2/g$.

Suitable polymers that can be used according to the invention can be non-ionic, amphoteric, or cationic, usually highly charged. Preferably the polymer is cationic. The polymer can be derived from natural or synthetic sources and can be linear, branched or cross-linked, e.g. in the form of particles. Preferably, the polymer is water-soluble or water-dispersible.

Examples of suitable cationic polymers include cationic polysaccharides, e.g. starches, guar gums, celluloses, chitins, chitosans, glycans, galactans, glucans, xanthan gums, pectins, mannans, dextrins, preferably starches and guar gums. Suitable starches include potato, corn, wheat, tapioca, rice, waxy maize, barley, etc. Cationic synthetic organic polymers such as cationic chain-growth polymers may also be used, e.g. cationic vinyl addition polymers like acrylate-, acrylamide-, vinylamine-, vinylamide- and allylamine-based polymers, for example homo- and copolymers based on diallyldialkyl ammonium halide, e.g. diallyldimethyl ammonium chloride, as well as (meth)acrylamides and (meth)acrylates. Further polymers include cationic step-growth polymers, e.g. cationic polyamidoamines, polyethylene imines, polyamines, e.g. dimethylamine-epichlorhydrin copolymers, and polyurethanes. Further examples of suitable cationic organic polymers include those disclosed in WO 02/12626.

According to one embodiment, the polymer is selected from the group of polydiallyidimethyl ammonium chloride, polyamines, cationic starch, amphoteric starch, and polyamidoeamine-epichlorohydrin (PAAE), polyethylene imines and polyvinylamines.

The term "step-growth polymer", as used herein, refers to a polymer obtained by step-growth polymerization, also being referred to as step-reaction polymer and step-reaction polymerization, respectively. The term "chain-growth polymer", as used herein, refers to a polymer obtained by chain-growth polymerization, also being referred to as chain reaction polymer and chain reaction polymerization, respectively.

The polymer used according to the invention should preferably have a molecular weight of from about 10,000 to about 10,000,000, preferably from about 15,000 to about 5,000,000, and most preferably from about 40,000 to about 1,000,000 g/mol.

The anionic compound used according to the invention is preferably an anionic microparticle, an anionic surfactant, or mixtures thereof. Examples of suitable anionic microparticles include anionic silica particles, preferably anionic colloidal silica particles and smectite clays, preferably anionic colloidal silica particles, most preferably anionic hydrophobically modified silica sols. The microparticles preferably have a specific surface area from about 40 to about 900, more preferably from about 150 to about 600, and most preferably from about 250 to about 400 $m^2/g$.

Colloidal silica particles may be derived from e.g. precipitated silica, micro silica (silica fume), pyrogenic silica (fumed silica) or silica gels with sufficient purity, and mixtures thereof.

Colloidal silica particles and silica sols according to the invention may be modified and can contain other elements such as amines, aluminium and/or boron, which can be present in the particles and/or the continuous phase. Boron-modified silica sols are described in e.g. U.S. Pat. No. 2,630,410. The aluminium modified silica particles suitably have an $Al_2O_3$ content of from about 0.05 to about 3 wt %, preferably from about 0.1 to about 2 wt %. The procedure of preparing an aluminium modified silica sol is further described in e.g. "The Chemistry of Silica", by Iler, K. Ralph, pages 407-409, John Wiley & Sons (1979) and in U.S. Pat. No. 5,368,833.

The colloidal silica particles suitably have an average particle diameter ranging from about 2 to about 150, preferably from about 3 to about 50, and most preferably from about 5 to about 40 nm. Suitably, the colloidal silica particles have a specific surface area from about 20 to about 1500, preferably from about 50 to about 900, and most preferably from about 70 to about 600 $m^2/g$.

Anionic surfactants that can be used according to the invention are generally anionic surfactants with hydrophobic groups having from about 6 to about 30 carbon atoms. Examples of preferred anionic surfactants are saponified fatty acids, alkyl(aryl)sulphonates, sulphate esters, phosphate esters, alkyl(aryl)phosphates, alkyl(aryl) phosphonates, fatty acids, naphthalene sulphonate (NAS) formaldehyde polycondensates, polystyrene sulphonates, hydrophobe-modified NAS. Most preferred are saponified fatty acids, alkyl(aryl) sulphonates, sulphate esters, phosphate esters, alkyl(aryl) phosphates, alkyl(aryl) phosphonates and mixtures thereof.

According to one embodiment, the anionic compound is an anionic surfactant.

Non-ionic surfactants that can be used according to the invention are generally ethoxylated or propoxylated fatty acids or fatty alcohols. The ethoxylated fatty acids and fatty alcohols have preferably been ethoxylated with from about 1 to about 30 ethylene oxide (EO), most preferably ethoxylated with from about 4 to about 25 EO. The ethoxylated fatty acids and fatty alcohols preferably have from about 6 to about 30 carbon atoms, most preferably from about 6 to about 22 carbon atoms. The propoxylated fatty acids and fatty alcohols have preferably been propoxylated with from about 1 to about 30 propylene oxide (PO), most preferably propoxylated with from about 1 to about 8 PO. The propoxylated fatty acids and fatty alcohols preferably have from about 6 to about 30 carbon atoms, most preferably from about 6 to about 22 carbon atoms. It is also possible to use carbon dioxide instead of propylene oxide.

Any oil, fat or wax can be used according to the invention. Suitable oils are refined and/or hydrogenated grade oils, preferably vegetable oils like grape oil, olive oil, coconut oil, rape seed oil, sunflower oil and palm oil, most preferably coconut oil. Other oils that can be used according to the invention are mineral oils and silicon oil.

According to one embodiment, both a non-ionic surfactant and an oil, wax or fat is added to the cellulosic suspension. However, the process works well also with sole addition of either a non-ionic surfactant or with sole addition of oil, wax or fat.

The anionic compound, the non-ionic surfactant and the oil, wax or fat are preferably substantially free from quaternary ammonium surfactants. By "substantially free" is meant that quaternary ammonium surfactants constitute less than 5 of the total amount of the polymer, the anionic compound, the non-ionic surfactant and the oil, wax or fat, preferably less than 1, and most preferably less than 0.5 wt %.

It is also possible to add further components to the cellulosic suspension conventionally used in the production of paper. To avoid deterioration of the different additives a preserving agent may be added. Several cosmetic additives can also be included, for example antioxidants, e.g. tocopherol, and aloe vera.

The smectite clay is suitably added in an amount of from about 0.1 to about 10, preferably from about 0.2 to about 5 and most preferably from about 0.3 to about 3 kg/ton dry cellulosic fibres.

The polymer is suitably added in an amount from about 0.01 to about 10, preferably from about 0.1 to about 5 and most preferably from about 0.2 to about 2 kg/ton dry cellulosic fibres.

The anionic compound is suitably added in an amount from about 0.001 to about 1, preferably from about 0.005 to about 0.5, and most preferably from about 0.01 to about 0.1 kg/ton dry cellulosic fibres.

The oil, fat or wax can be added in an amount from about 0.1 to about 10, preferably from about 0.3 to about 7, and most preferably from about 0.5 to about 5 kg/ton dry cellulosic fibres.

The non-ionic surfactant can be added in an amount from about 0.1 to about 10, preferably from about 0.3 to about 7, and most preferably from about 0.5 to about 5 kg/ton dry cellulosic fibres.

According to one embodiment, an emulsion comprising the anionic compound, the non-ionic surfactant and/or oil, fat or wax and the polymer is added separately from the smectite clay. Preferably the emulsion is added prior to the smectite clay.

According to one embodiment, an emulsion comprising the anionic compound, the non-ionic surfactant and/or oil, fat or wax and the smectite clay is added separately from the polymer. Preferably the emulsion is added prior to the polymer.

According to one embodiment, an emulsion comprising the anionic compound and the non-ionic surfactant and/or oil, fat or wax are added separately from the polymer and the smectite clay. Preferably the emulsion is firstly added, the polymer is added secondly and the smectite clay is added thirdly.

When used in the papermaking process according to the invention the anionic compound, the non-ionic surfactant and/or oil, wax or fat and the polymer can be prepared in advance and be delivered as one product to the paper mill. It is also possible to prepare one mixture comprising the anionic compound and the non-ionic surfactant and/or an oil, wax or fat and a second, aqueous solution comprising the polymer.

The smectite clay is preferably dispersed in water to form an aqueous dispersion. The aqueous dispersion with the smectite clay can either be produced in advance or the smectite clay can be dispersed in water on site. According to one embodiment, the smectite clay is added to the cellulosic suspension as a powder.

According to one embodiment, the oil, fat or wax, the anionic compound and the non-ionic surfactant are mixed to provide a premix in the form of an emollient-surfactant blend. The emollient-surfactant blend is preferably heated to about 20 to about 70, preferably to about 25 to about 55° C. An aqueous solution containing the polymer is prepared in which the polymer content is from about 0.1 to about 50, preferably from about 0.5 to about 25 wt %. The aqueous polymer solution is preferably also heated to about 20 to about 70, preferably to about 25 to about 55° C. According to one embodiment, an emulsion of the emollient-surfactant blend and the aqueous solution containing the polymer is prepared with, a static mixer, a high shear device called ultra-turrax or a homogenizer. The product emulsion can then be cooled to room temperature. The cooling can for example be done by using a heat exchanger.

The cellulosic fibres of the cellulosic suspension may include fibres derived from wood pulp, which includes chemical pulp such as Kraft, sulphite and sulphate pulps, as well as mechanical pulps such as ground wood, thermomechanical pulp and chemical modified thermomechanical pulp. Recycled fibres may also be used. The recycled fibres can contain all the above mentioned pulps in addition to fillers, printing inks etc. Chemical pulps, however, are preferred since they impart a superior feeling of softness to tissue sheets made from it. The utilization of recycled fibres for making tissue or fluff often includes a process step known as deinking to remove as much as possible of the printing ink from the fibre slurry and most of the filler material to get an acceptable brightness of the recycled fibre slurry and paper machine runnability. The deinking process often includes addition of anionic substances such as saponified fatty acids and water glass to the fibre slurry. These substances are sometimes carried over to the paper machine and due to the fact that they are anionic, they can inactivate cationic chemicals added to the stock. These substances are called anionic detrimental substances or "anionic trash".

To evaluate the performance of the papermaking process according to the invention a number of parameters can be measured. To determine the static electricity the static potential is measured. The effect of the debonder can be determined by measuring knot content, burst strength, defiberization energy and wetting rate. Low burst strength and low defiberization energy shows that the fibre-to-fibre bonds are weak, which enhances the softness. The wetting rate indicates the absorption capacity of the finished product Also, when fluff is used in air-laid applications, it is important to minimise the number of knots. The knots can be described as clusters of fibres. A high number of knots can lead to poor formation and runnability in the air-laid process.

In addition to cellulosic fibres, and the composition according to the invention as described herein, other components may be added to the cellulosic suspension used to make tissue or fluff. Such additives can for example be wet strength agents, dry strength agents and wetting agents as well as other components usually used in the production process. According to one embodiment, an additional polymer being either anionic, cationic, non-ionic or amphoteric, can be added to the cellulosic suspension. Suitably the polymer is either a natural polymer, for example starch, or a synthetic polymer.

According to one embodiment an anionic polymer is added, examples of suitable anionic polymers according to the invention include anionic step-growth polymers, chain-growth polymers, polysaccharides, naturally occurring aromatic polymers and modifications thereof.

The invention is further illustrated by the following examples but the invention is not intended to be limited thereto.

EXAMPLE 1

A coconut oil was mixed with a parasubstituted alkyl benzylsulfonic acid (~C12) (anionic surfactant) and an unsaturated fatty alcohol with 16 to 18 carbon atoms being ethoxylated with 5 EO (non-ionic surfactant). The contents of the components were 50 wt % oil, 1 wt % anionic surfactant, and 49 wt % non-ionic surfactants. The oil-surfactant blend was then heated to 50° C. An aqueous solution with a polymer was prepared. The concentration of the polymer in the aqueous solution was 4 wt %. The aqueous solution was heated separately to 50° C. The oil-surfactant blend was then emulsified into the aqueous solution by means of a high-shear equipment called ultra-turrax. The composition was then cooled to room temperature in a water bath. The weight ratio of the oil-surfactant blend to the aqueous solution was 15:85. The compositions prepared according to this description, A1 and A2, will hereinafter be referred to as debonder compositions. The polymers used in the composition are listed below.

For comparison, conventional debonder compositions, A3 and A4, marketed under the name Berocell®, have been used.

The debonder compositions used in the examples:

A1: 3.4 wt % Poly-DADMAC (SNF No. FL45DL)+the oil-surfactant blend

A2: 3.4 wt % Polyamine Bewoten C410+the oil-surfactant blend

A3: Berocell-589, hydrogenated tallow benzyl dimethyl ammonium chloride; unsaturated fatty alcohol, C16-18, ethoxylated with 5 EO, available from Eka Chemicals AB A4: Berocell-509, dihydrogenated tallow dimethyl ammonium chloride; unsaturated fatty alcohol, C16-C20, ethoxylated with 6 EO; fatty acid C12-C18, propoxylated with 6PO, available from Eka Chemicals AB The smectite clays, B1-B3, were dissolved in water to form an aqueous solution with 1 wt % smectite clay. The smectite clays used in the examples are:

B1: Laponite RD, a synthetic hectorite, hydrous Sodium Lithium Magnesium Silicate.

B2: Bentolite WH, an anionic Bentonite

B3: Hydrocol D, a synthetic Hectorite

The dry paper sheets were prepared by mixing 15 grams of chemical pine sulphate pulp with water up to 500 ml. The debonder composition was added to the pulp suspension followed by 10 minutes of agitation. The smectite clay, B1-B3, was added after 8 minutes of agitation. At 10 minutes the sheet is prepared in a standard PFI-sheetformer (A4 sheets). The sheets were then pressed according to the standardised method SCAN C26:76. Finally, the sheets were dried on a cylinder to 10 wt % moisture content.

EXAMPLE 2

In example 2 the static potential was measured for different combinations of debonder compositions and smectite clay. The amount of debonder composition added to the cellulosic suspension was 1.0 kg/ton based on dry cellulosic fibres. The amount of smectite clay was varied between 0 to 1.0 kg smectite clay/ton dry cellulosic fibres according to table 1. The static potential was measured with an Electrostatic field measurement device (JCI 148) and a high voltage head JCI (John Chubb Instrumentation 140) connected to a pin-defiberizer. The static potential is measured in kVolt.

TABLE 1

| Test No. | | 0 kg/ton (kVolt) | 0.5 kg/ton (kVolt) | 0.7 kg/ton (kVolt) | 1.0 kg/ton (kVolt) |
|---|---|---|---|---|---|
| 1 | A1 + B1 | 11 | −1.2 | −7.3 | −11.9 |
| 2 | A1 + B2 | 11 | 7.8 | 8.0 | 6.0 |
| 3 | A1 + B3 | 11 | 10 | 9.5 | 8.2 |
| 4 | A3 + B3 | −9.0 | −7.0 | −7.4 | −7.0 |

In table 1 it can be seen that in tests 1, 2 and 3, according to the present invention, the static potential can be adjusted by varying the amount of added smectite clay while adding the further components in the same amounts. When a conventional debonder was used (test no. 4) the static potential could not be adjusted by varying the added amount of smectite clay.

EXAMPLE 3

In example 3 the static potential was measured for different combinations of debonder compositions and smectite clay. The amount of the debonder composition added to the cellulosic suspension varied between 1.0 and 3.0 kg/ton dry cellulosic fibres. The amount of smectite clay varied between 0 to 0.7 kg/ton dry cellulosic fibres. The static potential was measured with an Electrostatic field measurement device (JCI 148) and a high voltage head JCI (John Chubb Instrumentation 140) connected to a pin-defiberizer. The static potential is measured in kVolt.

TABLE 2

| Test No. | | 1 kg debonder composition/ton | | | 3 kg debonder composition/ton | | |
|---|---|---|---|---|---|---|---|
| | | 0 kg/ton (kVolt) | 0.5 kg/ton (kVolt) | 0.7 kg/ton (kVolt) | 0 kg/ton (kVolt) | 0.5 kg/ton (kVolt) | 0.7 kg/ton (kVolt) |
| 1 | A2 + B1 | 11 | −6.3 | −9.7 | 11.2 | 7.7 | −0.7 |
| 2 | A4 + B1 | −11 | −10.3 | −11.8 | −11.5 | −12.2 | −12.7 |

In table 2 it can be seen that in test no. 1 according to the present invention the static potential was adjusted by varying the amount of added smectite clay. When a conventional debonder was used (test no. 2), the static potential could not be adjusted by varying the added amount of smectite clay.

EXAMPLE 4

In example 4 the knot content was measured for different combinations of debonder compositions and smectite clay. The amount of the debonder composition added to the cellulosic suspension varied between 1.0 and 3.0 kg/ton dry cellulosic fibres. The amount of smectite clay varied between 0 to 0.7 kg/ton dry cellulosic fibres. The knot content was measured using the standardised method SCAN-CM 37. The results can be seen in table 3.

TABLE 3

| Test No. | | 1 kg debonder composition/ton | | | 3 kg debonder composition/ton | | |
|---|---|---|---|---|---|---|---|
| | | 0 kg/ton (%) | 0.5 kg/ton (%) | 0.7 kg/ton (%) | 0 kg/ton (%) | 0.5 kg/ton (%) | 0.7 kg/ton (%) |
| 1 | A1 + B1 | 3.34 | 1.67 | 1.67 | 1.34 | 0 | 0 |
| 2 | A4 + B1 | 3.0 | 1.67 | 3.34 | 1.0 | 1.0 | 2.0 |

In table 3 it can be seen that a significant improvement in knot content is obtained when the debonding composition according to the invention is used compared to the conventional debonder. Addition of 1 kg conventional debonder composition/ton dry cellulosic fibres and 0.7 kg smectite clay/ton dry cellulosic fibres (test 2) resulted in a knot content of 3.34%. When a debonder composition and a smectite clay according to the invention was added in the same amounts (test 1) the knot content was 1.67% which indicates a significant improvement in formation and runnability.

The invention claimed is:

1. A papermaking process comprising adding to a suspension of cellulosic fibres:

(i) a smectite clay (ii) at least one anionic compound selected from anionic microparticles and anionic surfactants (iii) at least one polymer which is cationic, non-ionic or amphoteric (iv) at least one non-ionic surfactant; and/or an oil, wax or fat.

2. A process according to claim 1, wherein the smectite clay is modified with a cation or cationic group.

3. A process according to claim 1, wherein the smectite clay is modified with an alkali metal.

4. A process according to claim 1, wherein the smectite clay is modified with lithium.

5. A process according to claim 1, wherein the smectite clay is a synthetic hectorite.

6. A process according to claim 1, wherein said at least one polymer is a cationic polymer.

7. A process according to claim 1, wherein said at least one anionic compound is an anionic surfactant.

8. A process according to claim 1, wherein said at least one anionic surfactant is selected from saponified fatty acids, alkyl(aryl)sulfonates, sulfate esters, phosphate esters, alkyl (aryl)phosphates, alkyl(aryl)phosphonates, and mixtures thereof.

9. A process according claim 1, wherein an oil, wax or fat is added to the cellulosic suspension.

10. A process according to claim 1, wherein at least one non-ionic surfactant is added to the cellulosic suspension.

11. A process according to claim 1, wherein said at least one anionic compound, said at least one non-ionic surfactant(s) and the oil, wax or fat are substantially free from quaternary ammonium surfactants.

12. A process according to claim 1, wherein the smectite clay is added separately from said at least one anionic compound; said at least one polymer; and said at least one non-ionic surfactant(s); and/or the oil, wax or fat.

13. A process according to claim 1, wherein said at least one polymer is added separately from the smectite clay; said at least one anionic compound; said at least one non-ionic surfactant(s); and/or the oil, wax or fat.

14. A process according to claim 1, wherein said at least one anionic compound; said at least one non-ionic surfactant(s); and/or the oil, wax or fat are added as a premix in a first stage, said at least one polymer is added in a second stage and the smectite clay is added in a third stage.

15. A process according to claim 1, wherein the smectite clay is added in an amount of from about 0.1 to about 10 kg/ton dry cellulosic fibres.

16. A process according to claim 1, wherein said at least one anionic compound is added in an amount of from about 0.001 to about 1 kg/ton dry cellulosic fibres.

17. A process according to claim 1, wherein said at least one polymer is added in an amount of from about 0.01 to about 10 kg/ton dry cellulosic fibres.

18. A process according to claim 1, wherein said at least one non-ionic surfactant(s) is added in an amount of from about 0.1 to about 10 kg/ton dry cellulosic fibres.

19. A process according to claim 1, wherein the oil, wax or fat is added in an amount of from about 0.1 to about 10 kg/ton dry cellulosic fibres.

20. A papermaking process comprising adding to a suspension of cellulosic fibres:

(i) a synthetic hectorite (ii) at least one anionic surfactant or anionic microparticles (iii) at least one polymer which is cationic, non-ionic or amphoteric (iv) at least one non-ionic surfactant; and/or an oil, wax or fat.

21. A papermaking process comprising adding to a suspension of cellulosic fibres:

(i) a synthetic hectorite (ii) at least one anionic compound selected from anionic surfactants (iii) at least one polymer which is cationic, non-ionic or amphoteric (iv) at least one non-ionic surfactant; and/or an oil, wax or fat.

* * * * *